United States Patent [19]

Bernstein

[11] Patent Number: 4,934,674

[45] Date of Patent: Jun. 19, 1990

[54] TWO STATION, SINGLE ACTION VISE

[75] Inventor: Leon M. Bernstein, Minneapolis, Minn.

[73] Assignee: Kurt Manufacturing Company, Inc., Minneapolis, Minn.

[21] Appl. No.: 327,517

[22] Filed: Mar. 22, 1989

[51] Int. Cl.[5] ..... B25B 1/20

[52] U.S. Cl. ..... 269/43; 269/136; 269/154; 269/242; 269/906

[58] Field of Search ..... 269/43, 136, 138, 153, 269/154, 242, 906

[56] References Cited

U.S. PATENT DOCUMENTS

| | | | |
|---|---|---|---|
| 62,584 | 3/1867 | Williams et al. . | |
| 2,299,294 | 10/1942 | Barnes | 90/60 |
| 3,861,664 | 1/1975 | Durkee | 269/43 |
| 3,927,873 | 12/1975 | Chambers | 269/154 |
| 4,241,906 | 12/1980 | Cole | 269/43 |
| 4,341,375 | 7/1982 | Romanin | 269/43 |
| 4,529,183 | 7/1985 | Krason | 269/43 |

*Primary Examiner*—Judy Hartman

*Attorney, Agent, or Firm*—Kinney & Lange

[57] ABSTRACT

A two station, single action vise has a body, with a fixed center block forming oppositely facing fixed jaws, and movable jaws at opposite ends of the body that are moved by operation of a vise screw toward one of the respective oppositely facing fixed jaws in the center of the body. The vise screw is spring centered and will yield to apply a preclamp with one of the jaws onto a piece part. The movable jaws are shown operated by a vise screw that has left-hand threads for operating one of the movable jaws and right-hand threads for operating the other movable jaw, so that as the screw is rotated both movable jaws move simultaneously toward the center block forming the fixed jaws. In this way two work pieces can be clamped by the movable jaws against the center fixed jaw. In order to preclamp piece parts under a spring load the screw is moved so it can shift axially slightly under spring load after preclamping one part until both movable jaws are positioned to clamp their respective piece parts tightly. The vise screw also can be adjusted axially relative to the vise body to shift one movable jaw relative to the fixed jaw to a different position than the first jaw for purposes of permitting different size parts to be clamped by the respective jaws.

5 Claims, 2 Drawing Sheets

TWO STATION, SINGLE ACTION VISE

BACKGROUND OF THE INVENTION

1. Field of the Invention.

The present invention relates to a precision machine vice that will clamp two work pieces against oppositely facing surfaces of a common center-mounted fixed vise jaw.

2. Description of the Prior Art.

The concept of having a vise that has a body with a center fixed block and movable jaws that move toward this block for holding members has been shown in the Prior Art in various embodiments. For example, U.S. Pat. No. 62,584 shows a vise type member which in its preferred embodiment uses a cam to move outer jaws in toward a center fixed jaw. The movable jaws will move in a sequential manner utilizing the cam when the resistance of one of the jaws is less than the other. A final clamping is made with equal pressure being exerted by the cam member or by a screw which is described as being an alternative to the core of the cam member.

Clamping devices which utilize screws having oppositely-directed or opposite "hand" threads on two parts thereof and which actuate movable jaws against the center jaw are also shown in a number of ski clamping devises such as in U.S. Pat. No. 3,861,664. U.S. Pat. No. 3,861,664 shows a pair of jaws which, essentially, float relative to a center jaw or reference member. The movable jaws are simultaneously actuated by a screw-threaded member driving nuts that move the jaws in toward the center jaw or block.

U.S. Pat. No. 2,299,294 shows a work-holding device that provides for clamping a plurality of work pieces against members which can be fixed, or which can float.

U.S. Pat. No. 4,241,906 also shows a ski vise which has a fixed jaw at one end which has means for actuating movable jaws toward the fixed jaw to clamp a pair of skis.

U.S. Pat. No. 4,341,375 discloses a dual ski vise. This device has two movable jaws between two fixed jaws for clamping in either direction of movement.

U.S. Pat. No. 4,529,183 shows a machine vise that has a fixed center jaw, and sequential operation of movable jaws that move from opposite ends of a vise body toward the center. In this device the screw has one threaded section which will first close one of the jaws, until that jaw engages a workpiece, and then the other jaw is moved to clamp onto a second work piece.

SUMMARY OF THE INVENTION

The present invention relates to a machine vise which has a vise body having a fixed center jaw block, and having rapidly operating, simultaneously movable jaws at opposite ends of the body, to cause the movable jaws to move toward the center block and clamp work pieces on opposite sides or faces of the fixed center jaw block. Two work pieces, thus, can be clamped on the vise and in a precisely-located position.

The movable jaws are moved simultaneously by a suitable actuator, such as a vise screw having left-hand threads to drive one movable jaw and right-hand threads to drive the other movable jaw. The actuator is spring-mounted relative to the body so that it can shift slightly in the direction of closing of the jaws to provide a spring preclamp force to one of the parts prior to clamping the second part. The permitted shifting or translation of the actuator relative to the body will permit the second jaw to contact its piece part while the first part is held under the preclamp force so that the final clamping of the piece parts will result in equal clamping pressure being applied to both of the parts on opposite faces of the fixed jaw through the vise screw.

In the form shown, the vise screw is mounted in a sleeve that is biased to a centered position relative to an end wall of the vise body through the use of springs on opposite sides of the end wall. The vise screw is releasably fixed to the sleeve. The sleeve and vise screw can then shift axially slightly under spring load in either direction of movement to accommodate translation or longitudinal movement of the vise screw in order to provide a preclamping pressure to one part and, then, clamping both of the piece parts.

If one part clamped by one of the movable jaws has dimensions that are substantially different from the part being clamped by the other movable jaw, the vise screw can be adjusted relative to the sleeve so that the positions of the movable jaws relative to the fixed jaw block are unequal. This adjustment can be used for accommodating two differently sized parts that are to be clamped simultaneously, while still permitting a spring preclamp. The spring preclamp permits holding the first part in its proper position under a low clamping force which permits positioning or alignment of the parts by the user and which retains the first part in position until the second part has been clamped.

The vise construction is economical, efficient, and provides for increased production with positively positioned and clamped piece parts.

DETAILED DESCRIPTION OF THE PREFERRED EMBODIMENTS

Figure 5:
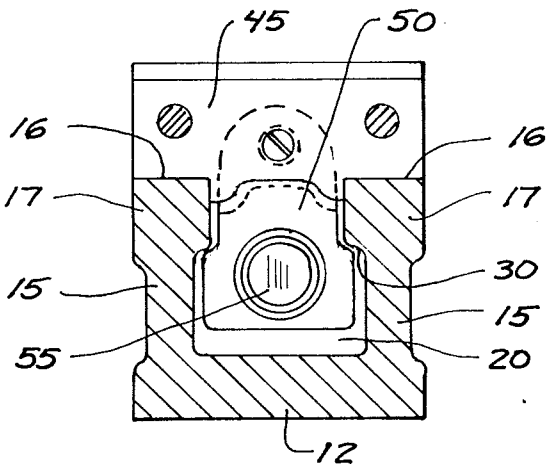
FIG. 5 is a sectional view taken as on line 5—5 and FIG. 2.
Figure 4:
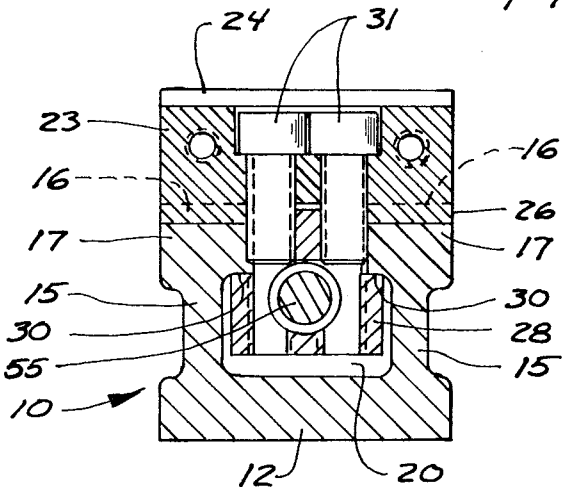
FIG. 4 is a sectional view taken as on line 4—4 and FIG. 2.

A two station, single action vise indicated generally at 10 comprises a vise body 11 that is elongated along the longitudinal central axis, and which has a base plate 12, and an upright end wall 13, that extend uprightly from the base wall 12. The body 10, as shown in FIGS. 4 and 5, further includes side walls which are indicated at 15, and these have upper rail portions 17 that form top rail or way surfaces 16, which are spaced apart and extend along the length of the vise body. The spaced apart rail surfaces 16 are flat and parallel and a slot is formed between them. The sidewalls 15 and the rail portions 17 define an interior channel 20 that extends along the length of the vise.

Figure 1:
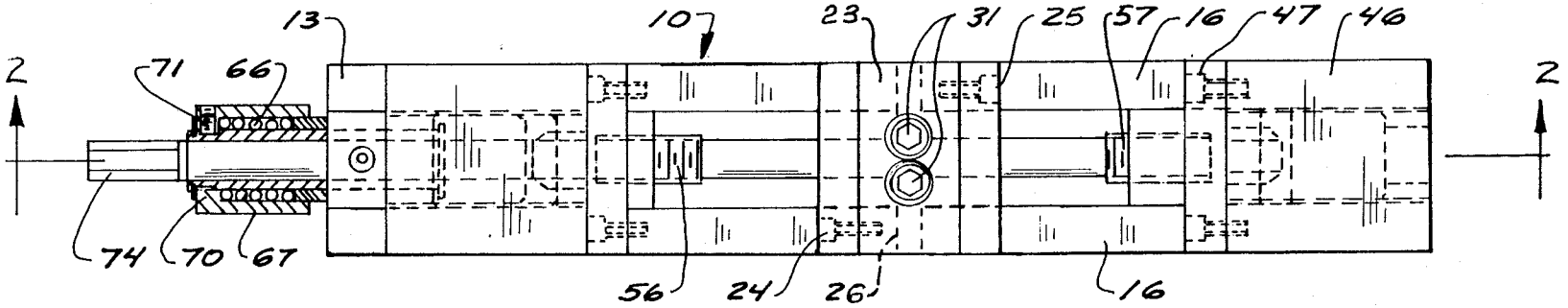
FIG. 1 is a top plan view of a vise made in accordance with the present invention showing both of the jaws in a fully open position.

The rail portions 17 support a centrally-located fixed jaw assembly indicated generally at 22 which as shown includes a fixed jaw block 23 and oppositely-facing fixed jaw plates 24 and 25, respectively. The jaw plates are fixed to the block 23. The block 23 has a key or lug indicated at 26, that fits into a cross groove shown in dotted lines in FIG. 1 formed in the rail portions 17, and which extends below the surfaces 16. The fixed jaw block 23 is then clamped and locked in place with a clamp block 28 that is fitted within the slot between surfaces 16 and in channel 20, and which is clamped up against shoulders 30 formed on the lower, inner edges of the rail portions 17. The shoulders 30 interface with shoulders on the clamp block 28 and then the clamp block 28 is drawn up tightly against the shoulders 30 on the rail portion using cap screws 31 that pass down through the block 23. Jaw plates 24 and 25 are removable from the block 23 and can be replaced when desired.

The center plane of the fixed jaw block 23 is approximately midway between the ends of the vise body. The block 23 provides oppositely facing fixed vise jaws.

There are a pair of movable jaws on the vise body 11, one adjacent to each of the opposite ends. These movable jaws are each made in two parts, as will be shown and as is well known. At the first end of the body, there is a first jaw assembly 35 which has a first movable jaw body or block 36 carrying a jaw plate 37, which faces the jaw plate 24. The jaw block 36 is actuated through a movable jaw nut 40 that has an internally threaded hub 42. The nut is slidably guided between the rail portion 17 and has shoulders which fit underneath the shoulders 30 of rail portion 17. The nut 40 will slide between the rail portions when the nut is actuated. The nut 40 has a head portion 43 that fits into a recess in the first movable jaw block 36 and acts to move the jaw through the use of a hemispherical segment 44 that is seated in a complementally shaped seat in the jaw block 36. The hemispherical segment 44 is free to swivel a limited amount in its seat and the head portion 43 of nut 40 has an inclined surface 43A that bears against the hemispherical segment 44 to transfer motion tending to clamp the first movable jaw against a workpiece. The jaw plate 37 will be moved toward the center fixed jaw assembly 22. A set screw 44A is used to keep the inclined surface of the head 43 in contact with the hemispherical segment. This type of inclined surface on the head 43 bearing on a hemispherical segment 44 is well known in the field.

A second movable jaw assembly 45 is at an opposite or distal end of the vise body 11, and operates in the same manner as the first jaw assembly. The second movable jaw assembly includes a jaw block 46 that carries a jaw plate 47. A second movable jaw nut 50 is made in the same manner as the previously explained nut 40, and includes a hub 52 that is internally threaded, but is threaded with the opposite hand or lead from hub 42. A head 53 bears against a hemispherical segment 54.

The actuator means for the two movable jaws, as illustrated in this form of the invention, is specifically a vise screw or shaft 55 which has a first threaded section 56 that threadably mates with the internal threads of the hub 42 of the nut 40 for the first movable jaw assembly the screw and a second threaded section 57 near its distal end that mates with the internal threads in the hub 52 of the nut 50 of the second movable jaw. The vise screw is supported at end wall 13 and is supported at its distal end by the nut 50 and the head 53 of the nut 50 acting against the hemispherical segment 54. The vise screw weight is supported through the hemispherical segment 54 to the jaw block 46 which rests on, and is supported by, the rail surfaces 16.

A crank end of the vise screw 55 extends through end wall 13 and is mounted through a sleeve 60 which, in turn has an outer surface rotatably and slidably mounted in an opening in the end wall 13, or other suitable upright wall provided for supporting the screw adjacent its drive end. The sleeve is preferably made of a material that will be easily rotated and which will easily slide in the opening in the end wall 13.

The sleeve 60 extends into the interior bore 20 of the vise body. A compression spring 61 is mounted over the sleeve 60 at the internal end of the sleeve 60 and bears against a flange 62 on the end of sleeve 60. Additionally, there is a backing washer 63 at an inner end of a counter bore 64 of the end wall 13. The spring 61 fits partially into counter bore 64. The spring 61 reacts forces between flange 62 and wall 13. On the outer side of the wall 13 there is a ring spacer or block 65 that fits over the sleeve 60 and this spacer 65 has one end that bears against the outer surface of the end wall 13. A spring 66 is positioned over the sleeve 60 and engages the opposite or outer end of the spacer ring 65. The spring 66 is retained within a tubular housing 67 that slides over the spring 61 and spacer ring 65. Housing 67 has an end flange 70 that traps the spring 61 between the spacer ring 65 and the end flange 70. A snap ring 72 is retained on the sleeve 60 to keep the tubular housing 67 in place on the sleeve 60.

A radial lock set screw 71 is threadably mounted through the end flange 70, the sleeve 60 and bears against the outer surface of the sleeve 60. When the set screw 70 is tightened, it will deform the sleeve 60 and lock it onto the vise screw 55 at the end portion 73 of the vise screw that passes through the sleeve 60.

A drive end 74 is provided on the vise screw 55 for attaching a hand crank for driving the vise screw in a desired manner.

The springs 61 and 66 act in opposition to each other to center the sleeve 60 relative to end wall 13 when the forces are balanced. With the set screw 71 loosened the vise screw 55 can be shifted axially to permit adjusting the movable jaws relative to the center fixed jaw so a preclamping load, caused by compressing one of the springs 61 or 66, will be applied to one work piece by one movable jaw before the second work piece is clamped by the other movable jaw. Once the screw has been adjusted the selected work piece will receive the preclamp load before the other wall piece is clamped, the set screw 71 is tightened down. Rotation of the screw will cause both movable jaws to move either toward or away from the center block.

Figure 2:
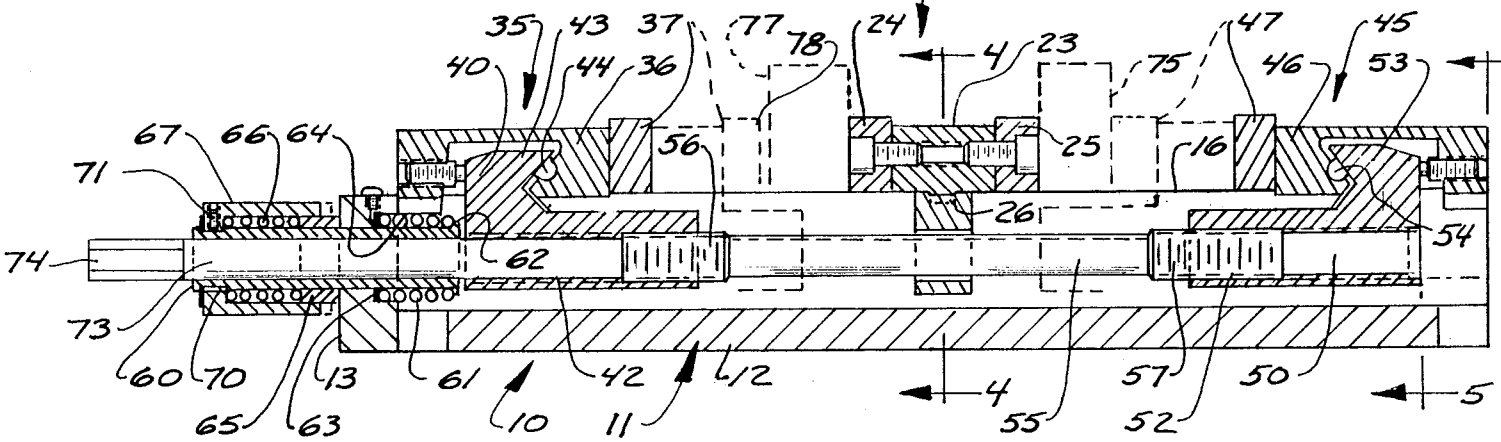
FIG. 2 is a sectional view taken as on line 2—2 and FIG. 1.

As is illustrated in dotted lines in FIG. 2, a piece part 75 can be placed between the jaw plate 33 on the fixed jaw block 23 and the jaw plate 47 of the second or distal movable jaw 45. The movable jaw 45 can then be moved by rotating the screw 55 in a selected direction until the movable jaw 45 contacts this workpiece as shown in dotted lines at 47 in FIG. 2. A different workpiece 77 is in place against the fixed jaw plate 24, and the first movable jaw 35 will be moved in direction toward the piece part 77. The portion of the screw 55 in sleeve 60 has been adjusted so that when piece part 75 is under a spring preclamp load, jaw plate 37 has a slight clearance indicated at 78 between the surface of the piece part 77 and the jaw plate 37. Further tightening of the vise jaws from the position shown in dotted lines in FIG. 2 with the space 78 by the workpiece 77, will cause the spring 66 to compress, reacting a further preclamp load on the jaw plate 47 until the jaw plate 37 contacts and clamps against the surface of the workpiece 77. Then, both of the piece parts can be clamped securely against the fixed jaw assembly 22 under loads expected by tightening the vise screw.

Figure 3:
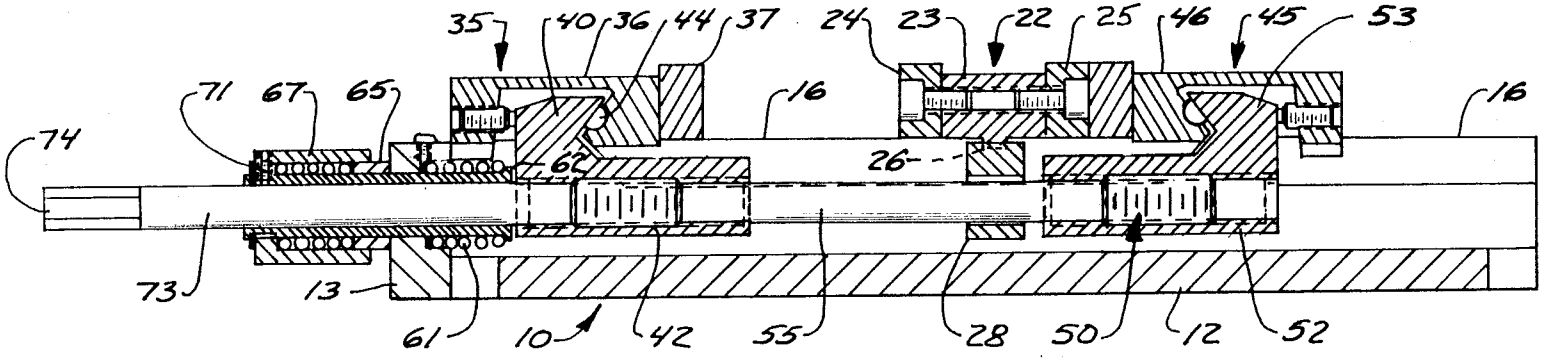
FIG. 3 is a sectional view taken on the same line as FIG. 2, but showing an adjusted position of the vise screw and movable jaws for accommodating two different size parts.

FIG. 3 illustrates the ability to change the axial setting of the sleeve 60 relative to the end section 73 to accommodate different size parts on opposite sides of the fixed block. Set screw 71 is loosened and the screw 55 can be extended to the left as shown in FIG. 3 threading the screw and threaded sections 56 and 57 into the respective hubs of the respective jaw nuts. The first jaw assembly 35 will remain fully open but the second jaw assembly 45 will be moved toward block 22. The end portion of the screw 55 will slide through the sleeve 60 until the second jaw assembly 45 is at the desired position. Once the set screw 71 is tightened piece parts can be clamped in the two jaws as before with one of the piece parts being under a preclamp load before both parts are clamped. As shown in FIG. 3, the space between the jaw plate 37 and jaw plate 24 can be substantially greater than the space for clamping parts with Movable jaw assembly 45. The movable jaw assembly actually can be closed before the movable jaw assembly 35 is moved from a fully open position as illustrated. The vise can be used as shown in FIG. 3 for clamping parts of different sizes. The position of vise screw 55 in sleeve 60 can be adjusted to substantially any location between the two positions shown in FIGS. 2 and 3 to accommodate various part sizes at one jaw which differ from part sizes at the other jaw, while still retaining the preclamp feature.

The same type of simultaneous actuation with the spring preclamping, can be used in other types of actuators, such as fluid pressure cylinders, cams, and the like as well as screw thread actuation.

Although the present invention has been described with reference to preferred embodiments, workers skilled in the art will recognize that changes may be made in form and detail without departing from the spirit and scope of the invention.

What is claimed is:

1. A machine vise adapted to hold two work pieces, each located precisely with respect to a fixed reference location, said vise comprising a body, fixed jaw means mounted on said body at a location spaced from both of opposite ends thereof, jaw actuator means comprising a vise screw mounted on said base and having right and left hand screw thread sections thereon, first and second movable jaws threadably mounted on the right and left hand thread section of said vise screw respectively and slidably mounted on said body, both of the movable jaws being positively and simultaneously movable between positions adjacent said fixed jaw means to position spaced from the fixed jaws means upon rotation of said, said vise screw providing a positive force for closing, means to mount said vise to said body to permit limited movement of said vise screw in opposite axial directions of movement of the vise screw relative to the body from a centered position, said vise screw being mounted through a plate on said body, a sleeve surrounding a portion of said vise screw, said sleeve being mounted for limited axial movement relative to said plate, means for adjustably fixing the axial position of said vise screw relative to said sleeve, and means for biasing said sleeve toward a centered position comprising separate springs on opposite sides of the plate of said vise, said springs acting between the said plate and spring retainer means formed on said sleeve.

2. The apparatus as specified in claim 1 wherein said spring retainer means comprises a shoulder on a first end of said sleeve, and a housing slidably mounted onto a second end of said sleeve, said housing surrounding a spring at the second end of said sleeve, said second end of said sleeve being external of the vise body.

3. The apparatus as specified in claim 2 wherein said movable jaws each have a nominal opening space relative to the fixed jaw means at their open position which is substantially equal for each of said movable jaws, and wherein said vise screw can be adjusted relative to said sleeve a distance in direction along the axis of said screw that is substantially equal to the nominal opening.

4. The apparatus as specified in claim 3 and set screw means in said housing adapted to engage said sleeve and force said sleeve against said screw to comprise said adjustable means.

5. The apparatus as specified in claim 1 wherein said movable jaws each comprise two parts, a first part of each jaw comprising a slide member mounted on said body and movable along said body, and a second part comprising a threadably actuated member, and hemispherical segment members seated in inclined surfaces of said threadable members, respectively for causing jaw closing movement to be transferred from the second parts to the respective first part.

* * * * *

UNITED STATES PATENT AND TRADEMARK OFFICE

CERTIFICATE OF CORRECTION

PATENT NO. : 4,934,674

DATED : June 19, 1990

INVENTOR(S) : Leon M. Bernstein

It is certified that error appears in the above-identified patent and that said Letters Patent is hereby corrected as shown below:

On the title page item [56]:

In the References Cited Section, insert the following:

OTHER PUBLICATIONS

Jigs and Fixtures, 1967, pages bearing illustration 681-684; 692-695; 696-699; 700-703; 704-708; 709-714; and 719-721.

First Russian Publication, published 1960, pages 109, 110 and 111.

Second Russian Publication, published 1979, page 566.

Third Russian Publication, page 110.

Signed and Sealed this

Fifth Day of May, 1992

*Attest:*

*Attesting Officer*

DOUGLAS B. COMER

*Acting Commissioner of Patents and Trademarks*